US007341657B2

(12) United States Patent
Li et al.

(10) Patent No.: US 7,341,657 B2
(45) Date of Patent: Mar. 11, 2008

(54) PROCESS FOR REDUCING SULFUR AND OLEFIN CONTENTS IN GASOLINE

(75) Inventors: Dadong Li, Beijing (CN); Yulin Shi, Beijing (CN); Yunjian Hu, Beijing (CN); Yuanbing Xi, Beijing (CN); Mingfeng Li, Beijing (CN); Yahua Shi, Beijing (CN)

(73) Assignees: China Petroleum & Chemical Corporation, Beijing (CN); Research Institute of Petroleum Processing, Sinopec, Beijing (CN)

( * ) Notice: Subject to any disclaimer, the term of this patent is extended or adjusted under 35 U.S.C. 154(b) by 433 days.

(21) Appl. No.: 10/740,807

(22) Filed: Dec. 22, 2003

(65) Prior Publication Data

US 2005/0133410 A1 Jun. 23, 2005

(51) Int. Cl.
*C10G 65/02* (2006.01)

(52) U.S. Cl. ..... 208/89; 208/210; 208/216 R; 208/217

(58) Field of Classification Search ..... 208/89, 208/210, 216 R, 217
See application file for complete search history.

(56) References Cited

U.S. PATENT DOCUMENTS 3,957,625 A 5/1976 Orkin
4,397,739 A 8/1983 Jacquin et al.
5,391,288 A 2/1995 Collins et al.
5,399,258 A 3/1995 Fletcher et al.
5,411,658 A 5/1995 Chawla et al.
5,599,439 A 2/1997 Collins et al.
5,851,382 A * 12/1998 Sudhakar ..... 208/216 R
5,906,730 A 5/1999 Hatanaka et al.
5,985,136 A 11/1999 Brignac et al.
6,231,753 B1 * 5/2001 McKnight et al. ..... 208/217

FOREIGN PATENT DOCUMENTS

CN 1253993 5/2000
WO 01/79391 10/2001

OTHER PUBLICATIONS

English Language Abstract of CN 1253993, May 24, 2000.

* cited by examiner

*Primary Examiner*—Glenn A. Caldarola
*Assistant Examiner*—Prem C. Singh
(74) *Attorney, Agent, or Firm*—Scully, Scott, Murphy & Presser, P.C.

(57) ABSTRACT

Disclosed is a process for reducing sulfur and olefin contents in gasoline, comprising contacting gasoline feedstock and hydrogen with a hydrorefining catalyst and an paraffin-modification catalyst. The effluent of the process is separated to obtain a hydrotreated gasoline fraction free of mercaptan and having a low content of sulfur, e.g. less than 200 ppm, a low content of olefins, e.g. less than 20% by volume, and little octane loss. The hydrotreated gasoline fraction can be used as blending component of a final gasoline product.

12 Claims, 3 Drawing Sheets

PROCESS FOR REDUCING SULFUR AND OLEFIN CONTENTS IN GASOLINE

TECHNICAL FIELD

The present invention relates to a process for refining hydrocarbon oils in the presence of hydrogen. In particular, the present invention relates to a process for reducing sulfur and olefin contents in gasoline.

BACKGROUND OF THE INVENTION

With the increasing concern for the world environment protection, the harmful components in the exhaust gas of automobiles will be controlled stringently. In response to such controls, the quality of the fuel is required to be higher and higher. Thus, many countries have brought forward strict limitations on the quality of automobile gasoline, for example: oxygen content, vapour pressure, benzene content, total aromatic content, boiling point, olefin content, sulfur content etc. Thus, it is required by CAAA (USA) that, in nine most severely polluted states, by the year 2004, the sulfur content in RFG (Reformulated Gasoline) be less than 30 ppm, and the olefin content be less than 8.5%. The European Parliament also enacted an act which required that, by 2005, the sulfur content and olefin content in the gasoline be less than 30-50 ppm and 18% respectively. Accordingly, it is an important subject in the petroleum refining industry how to further reduce sulfur and olefin contents in gasoline.

By comparing the current Standards for Automobile Gasoline in China with Tier II quality standard of <<World-wide Fuel Charter>>, it can be concluded that the main problem about the automobile gasoline quality in China is the high contents of sulfur and olefins. High levels of sulfur and olefins in the automobile gasoline is mainly due to the high proportion of the fluidized catalytic cracking (FCC) gasoline in the gasoline pool. In China, the FCC gasoline is a main blending component, accounting for more than 80% in the gasoline blending pool. The FCC gasoline contains high levels of sulfur and olefins, especially when the feed of the FCC becomes heavier; thus, it is hard to obtain automobile gasoline with an olefin content less than 20%. At present, gasoline products from many refineries in China barely meet the current quality standard for automotive gasoline. Under the circumstances, a major approach to control the contents of sulfur and olefins in automobile gasoline is to reduce the contents of sulfur and olefins in FCC gasoline.

It is true that the conventional hydrogenation processes can be used to substantially reduce the contents of both sulfur and olefins in FCC gasoline. The hydrogenation process, however, results in olefins, high octane-number components, being saturated. Consequently, this process leads to heavy octane number loss, especially in the case of a gasoline with a relatively high content of olefins and a relatively low content of aromatics. FIG. 1 schematically shows a relationship between the octane number loss of a typical FCC gasoline, with high olefin content and low aromatics content, and the saturation degree of the olefins therein as the gasoline undergoes conventional hydrorefining. From the figure, it can be seen that, with the olefins being saturated higher, The loss of octane number of the gasoline product becomes higher when the olefin content is reduced to 19.3% by volume from 49.3% by volume, RON loss of the gasoline product is 12.3 units; when the olefins are completely saturated, RON loss of the gasoline product is 23.5 units. Obviously, it is more difficult to recover the octane number of the FCC gasoline, with high olefin content and low aromatics content, when processed by conventional hydrorefining process. In view of this, there is a need to develop a process for treating FCC gasoline to reduce its contents of sulfur and olefins with minimum octane loss.

U.S. Pat. No. 5,411,658 discloses a gasoline hydrorefining process, comprising employing a traditional hydrorefining catalyst to hydrorefine FCC gasoline, and then employing a β-zeolite catalyst to restore the octane number of the hydrorefined gasoline. The process was designed to treat a feedstock with a high final boiling point. Nevertheless, the process employs a high hydrorefining temperature and thus makes a large amount of aromatics saturated. As a result, RON octane number decreases substantially in the final product and is hard to restore.

U.S. Pat. No. 5,599,439 discloses a process for upgrading gasoline and reformate. The process comprises, in a first stage, hydrorefining the feed to remove the impurities of sulfur, nitrogen etc and saturate olefins. Then the effluent from the first stage is subjected to intermediate separating step; the gas with hydrogen sulfide, nitrogen, etc removed is directly recycled to the first stage, and the intermediate product oil enters the second step where it undergoes octane number restoring process in a fluidized bed reactor with no fresh hydrogen introduced therein. This process introduces a separator between the first and second stages, thus increasing the capital investment. In the meantime, the process employs a low operation pressure which adversely affects the long-term operation of the catalyst.

U.S. Pat. No. 5,391,288 discloses a gasoline upgrading process. In the process, the feed comprises the mixture of FCC oil and benzene-rich fraction oil isolated from the effluents of the reforming process. The process includes two reaction steps. In the first step, the feed material undergoes hydrorefining to reduce the contents of the impurities, such as sulfur, nitrogen etc, and at the same time to saturate olefins through hydrogenation. In the second step, the effluent from the first step is subjected to octane number restoring treatment in the presence of an acid-functional catalyst, mainly undergoing alkane cracking, and alkylation and transalkylation of the aromatics. The process adopts a relatively low space velocity in the hydrorefining step and employs a large amount of catalyst. Moreover, it employs a feed with benzene and thus produces a product containing relatively high content of aromatics.

U.S. Pat. No. 5,399,258 also discloses a process for upgrading gasoline. The process includes two steps. In the first step, the feedstock is subjected to hydrogenation to remove sulfur and nitrogen and saturate the olefins. The product from the first step directly enters the second step where it undergoes octane number restoring. The first step is operated at a high temperature, similar to that of the second step. Nevertheless, owing to the high reaction temperature in the first step, in the final product of the process, a large amount of mercaptan sulfur remains.

With gasoline feedstocks with a relatively low final boiling point, a relatively high level of olefins and a relatively low content of aromatics, the above-mentioned processes, when applied to reduce sulfur and olefin contents in gasoline feedstock, would lead to significant octane loss.

Therefore, there exists a need for a process for hydrotreating gasolines, especially those having a relatively low final boiling point, and a relatively high content of olefins and a relatively low content of aromatics, to deeply reduce the levels of sulfur and olefins, with minimum octane loss.

SUMMARY OF THE INVENTION

The object of the present invention is to provide a process for deeply reducing sulfur and olefin contents in gasoline, thus producing a gasoline product meeting Tier II quality standard of <<World-wide Fuel Charter>>, while ensuring minimum loss of antiknock index. The present process comprises:

a) contacting gasoline feedstock and hydrogen with a hydrorefining catalyst under reaction conditions including a hydrogen/gasoline ratio of 200-600 $Nm^3/m^3$, a hydrogen partial pressure of 1.0 to 4.0 MPa, a temperature of 200-380° C. and a liquid hourly space velocity of 3.0-5.0 $h^{-1}$; and b) contacting the hydrorefined gasoline and hydrogen with a paraffin-modification catalyst under reaction conditions including a hydrogen/gasoline ratio of 200-1000 $Nm^3/m^3$, a hydrogen partial pressure of 1.0-4.0 MPa, a temperature of 300-460° C. and a liquid hourly space velocity of 0.5-4.0 $h^{-1}$ to provide an effluent, which is separated to obtain the hydrotreated gasoline fraction, wherein the paraffin-modification catalyst comprises one or more noble or non-noble metals from Group VIII and/or Group VIB of the Periodic Table of Elements, supported over a supporter containing at least one zeolite.

The process of the present invention makes it possible to maximize sulfur removal, while reducing olefin content by at least 40% and minimizing octane loss. Thus, the process of the invention produces a gasoline product with a sulfur content of less than 200 ppm and an olefin content of less than 20% by volume, meeting Tier II quality standard of <<World-wide Fuel Charter>>, while ensuring minimum loss of antiknock index.

DETAILED DESCRIPTION OF THE INVENTION

Figure 1:
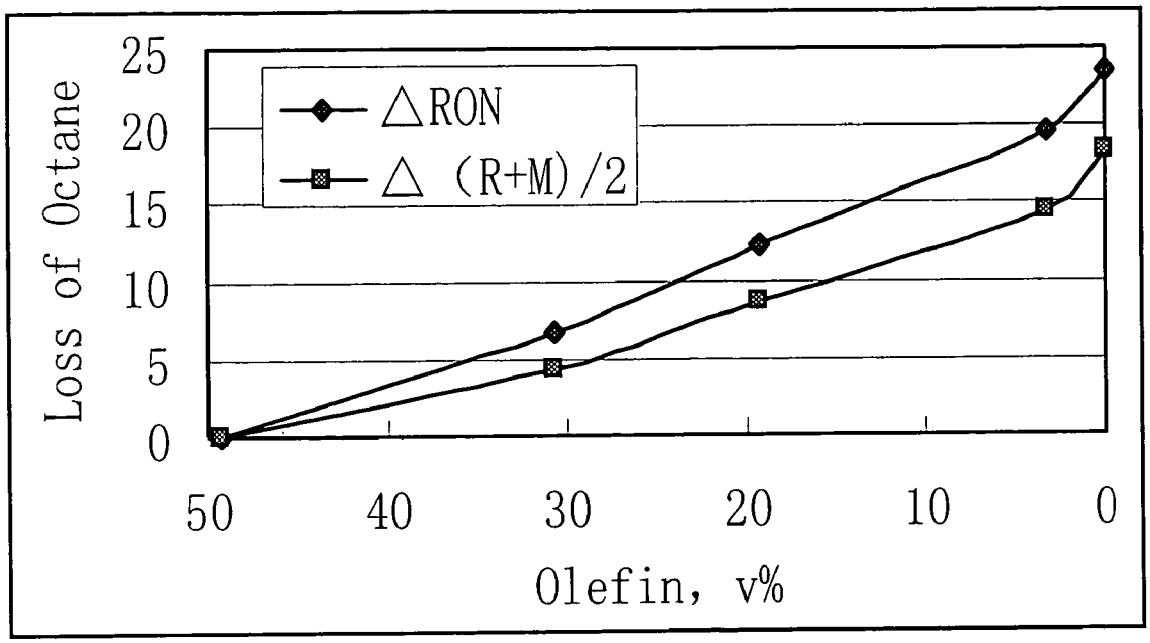
FIG. 1 shows a relationship between the octane number loss of a typical FCC gasoline, with a high olefin content and a low aromatics content, and the saturation degree of the olefins therein as the gasoline undergoes conventional hydrorefining.

Basically, the invention can be carried out as follows:

a) Gasoline feedstock and hydrogen are contacted with a hydrorefining catalyst under reaction conditions including a hydrogen/gasoline ratio of 200-600 $Nm^3/m^3$, a hydrogen partial pressure of 1.0-4.0 MPa, a temperature of 200-380° C. and a liquid hourly space velocity of 3.0-5.0 $h^{-1}$;

b) The hydrorefined gasoline and hydrogen are contacted with a paraffin-modification catalyst under reaction conditions including a hydrogen/gasoline ratio of 200-1000 $Nm^3/m^3$, a hydrogen partial pressure of 1.0-4.0 MPa, a temperature of 300-460° C. and a liquid hourly space velocity of 0.5-4.0 $h^{-1}$.

The effluent from step b) is separated to obtain the hydrotreated gasoline fraction. In the process, the paraffin-modification catalyst comprises one or more noble or non-noble metals from Group VIII and/or Group VIB, supported over a supporter containing at least one zeolite.

Said gasoline feedstock includes FCC gasoline, deep catalytic cracking (DCC) gasoline, straight-run gasoline, coker gasoline, pyrolysis gasoline, thermal cracking gasoline and a mixture thereof. The gasoline feedstock can be the whole fractions of the above-mentioned gasolines. Alternatively, the gasoline feedstock can be a part of the whole fractions of the above-mentioned feeds; in that case, the gasoline feedstock is the heavy fraction cut at a temperature of 70-100° C. The gasoline feedstock contains 1-70% by volume, preferably 20-65% by volume, and more preferably 35-60% by volume of olefins. The process of the present invention is preferably used to process a gasoline feedstock with high olefin content.

Said hydrorefining catalyst comprises one or more non-noble metals from Group VIB and/or Group VIII, supported over alumina or amorphous aluminum silicate.

Said paraffin-modification catalyst comprises one or more non-noble metals or noble metals from Group VIB and/or Group VIII, supported over a supporter containing at least one zeolite. A preferred paraffin-modification catalyst comprises 0.5-10% by weight of one or more metals from Group VIII and/or Group VIB, and 10-75% by weight of a zeolite, the balance being alumina. The most preferred paraffin-modification catalyst comprises 1-5% by weight of Ni and/or Co, 5-30% by weight of W or Mo, and 30-70% by weight of ZSM-5 zeolite, the balance being alumina.

The gasoline feedstock is preferably contacted with a hydro-protecting catalyst before the feed is contacted with the hydrorefining catalyst, so as to eliminate the dienes and therefore prevent coking at the top of the hydrorefining catalyst. Thus, the hydrorefining catalyst can be maintained at a high activity level over an extended period. The hydro-protecting catalyst can be loaded in the same reactor as the hydrorefining catalyst, or loaded in a reactor different from that wherein the hydrorefining catalyst is loaded.

Said hydro-protecting catalyst comprises one or more metals from Group VIII, one or more metals from Group VIB, and one or more alkali metals, supported over an alumina supporter. A preferred hydro-protecting catalyst comprises an alumina supporter and Co and/or Ni, Mo and/or W and an alkali metal, supported over the alumina supporter. Calculated as oxides and based on the total amount of the catalyst, the catalyst comprises 0.5-8% by weight of Co and/or Ni, 2-25% by weight of Mo and/or W, 0.5-8% by weight of the alkali metal, the balance being the alumina supporter. In a more preferred embodiment, the hydro-protecting catalyst comprises Co and/or Ni in an amount of 1-6% by weight, Mo and/or W in an amount of 4-12% by weight and the alkali metal in an amount of 2.5-6% by weight, all calculated as oxides and based on the total amount of the catalyst, the balance being the alumina supporter.

The hydro-protecting catalyst used in the present invention can be prepared as follows: Under the conditions sufficient for Mo and/or W, Co and/or Ni and an alkali metal to be deposited into the alumina supporter, the alumina supporter is contacted with a solution of compounds containing Mo and/or W, Co and/or Ni and an alkali metal by impregnation, co-precipitation etc, preferably by impregnation. During the impregnation, Mo and/or W, Co and/or Ni and the alkali metal can be introduced into the alumina supporter simultaneously or respectively.

Said compounds containing Mo can be one or more water soluble compounds containing Mo. For example: molybdenum oxide, molybdate, and para-molybdate. Preferably, molybdenum oxide, ammonium molybdate, and ammonium para-molybdate.

Said compounds containing W can be one or more water soluble compounds containing W. For example: tungstate, meta-tungstate and ethyl-meta-tungstate. Preferably, ammonium meta-tungstate and ammonium ethyl-meta-tungstate.

Said compounds containing Co can be one or more water soluble compounds containing Co. For example: cobalt nitrate, cobalt acetate, basic cobalt carbonate, cobalt chloride and water soluble cobalt complexes. Preferably, cobalt nitrate and basic cobalt carbonate.

Said compounds containing Ni can be one or more water soluble compounds containing Ni. For example: nickel nitrate, nickel acetate, basic nickel carbonate, nickel chloride and water soluble nickel complexes. Preferably, nickel nitrate and basic nickel carbonate.

Said compounds containing alkali metal can be one or more water soluble compounds containing alkali metal. Preferably the alkali metal is potassium. More preferably, the compounds containing potassium are potassium hydroxide, potassium nitrate, potassium chloride, potassium acetate, potassium phosphate, potassium hydrogen phosphate, and potassium dihydrogen phosphate and a mixture thereof.

The hydro-protecting catalyst used in the present invention can be molded into various shapes as desired. For example microspheres, spheres, tablets, bars and pellets. The molding process can be any conventional processes for that purpose, such as pelletization, bowling, extruding, etc.

The hydrorefining and the paraffin-modification reactions usually proceed in fixed bed reactors.

The process of the present invention is preferably carried out as follows:

1. a gasoline feed is cut at a temperature of 70-100° C. into a light fraction(LCN) and a heavy fraction(HCN);
2. the light fraction is extracted with an alkali to effect sweentening, i.e. to remove mercaptan therefrom;
3. the heavy fraction, together with hydrogen, is contacted with a hydrorefining catalyst, or contacted successively with a hydro-protecting catalyst and a hydro-refining catalyst, controlling the effluent from the hydro-refining reactor to have a nitrogen content of less than 2 ppm and an olefin content of less than 5% by volume; the effluent from the hydrorefining reactor, without separation, is contacted with a paraffin-modification catalyst to enhance the ratio of i-paraffin to n-paraffin through cracking and isomerization; the effluent from the paraffin-modification reactor is separated to obtain light hydrocarbons and the hydrotreated gasoline fraction, while the hydrogen-rich gas is recycled; and
4. the sweentened light fraction and said hydrotreated gasoline fraction from step 3 are blended in a gasoline pool.

The gasoline feed used in the preferred embodiment of the present invention is FCC gasoline, DCC gasoline, straight-run gasoline, coker gasoline, pyrolysis gasoline, thermal cracking gasoline and a mixture thereof. The feed usually has a final boiling point equal to or less than 220° C., lower than its counterparts from countries other than China. In FCC gasoline, sulfur distributes mainly in high-boiling fractions, and olefin content increases as the fraction boiling points decrease. In China, FCC gasoline has a high content of olefins and a low content of aromatics. Thus, when FCC gasoline is subjected to hydrodesulfurization, leading to heavy octane number loss, for most olefins are saturated. Thus, following hydrodesulfurization, it is necessary to further process the gasoline to increase the ratio of i-paraffin to n-paraffin, so as to compensate for octane number loss.

The alkali used in step 2 is a hydroxide of alkali metal or earth alkali metal, such as sodium hydroxide. The alkali is usually used as an aqueous solution.

In step 3, the hydrorefining usually proceeds under reaction conditions including a hydrogen/gasoline ratio of 200 to 600 $Nm^3/m^3$, a hydrogen partial pressure of 1.0 to 4.0 MPa, a temperature of 200 to 380° C. and a liquid hourly space velocity of 3.0 to 5.0 $h^{-1}$. The catalyst used in the hydrorefining process comprises one or more non-noble metals from Group VIB and/or Group VIII, supported over an alumina or amorphous aluminum silicate. The paraffin-modification procedure proceeds under reaction conditions including a hydrogen/gasoline ratio of 200 to 1000 $Nm^3/m^3$, a hydrogen partial pressure of 1.0 to 4.0 MPa, a temperature of 300 to 460° C. and a liquid hourly space velocity of 0.5 to 4.0 $h^{-1}$.

It is the combination of the effects of the hydrorefining catalyst and paraffin-modification catalyst, or through the combination of the effects of the hydro-protecting catalyst, hydrorefining catalyst and paraffin-modification catalyst, the process of the present invention achieves the object of the invention.

The hydrotreated gasoline fraction, obtained from the optional hydroprotecting process, the hydrorefining and paraffin-modification of the heavy fraction, is free of mercaptan, and requires no further treatment for removing mercaptans. It can thus be blended with the sweetened light fraction to provide a final gasoline product with a mercaptan sulfur level, less than 10 ppm, meeting the requirement of the gasoline product specification.

The present invention will be described in more detail by reference to the figures.

Figure 2:
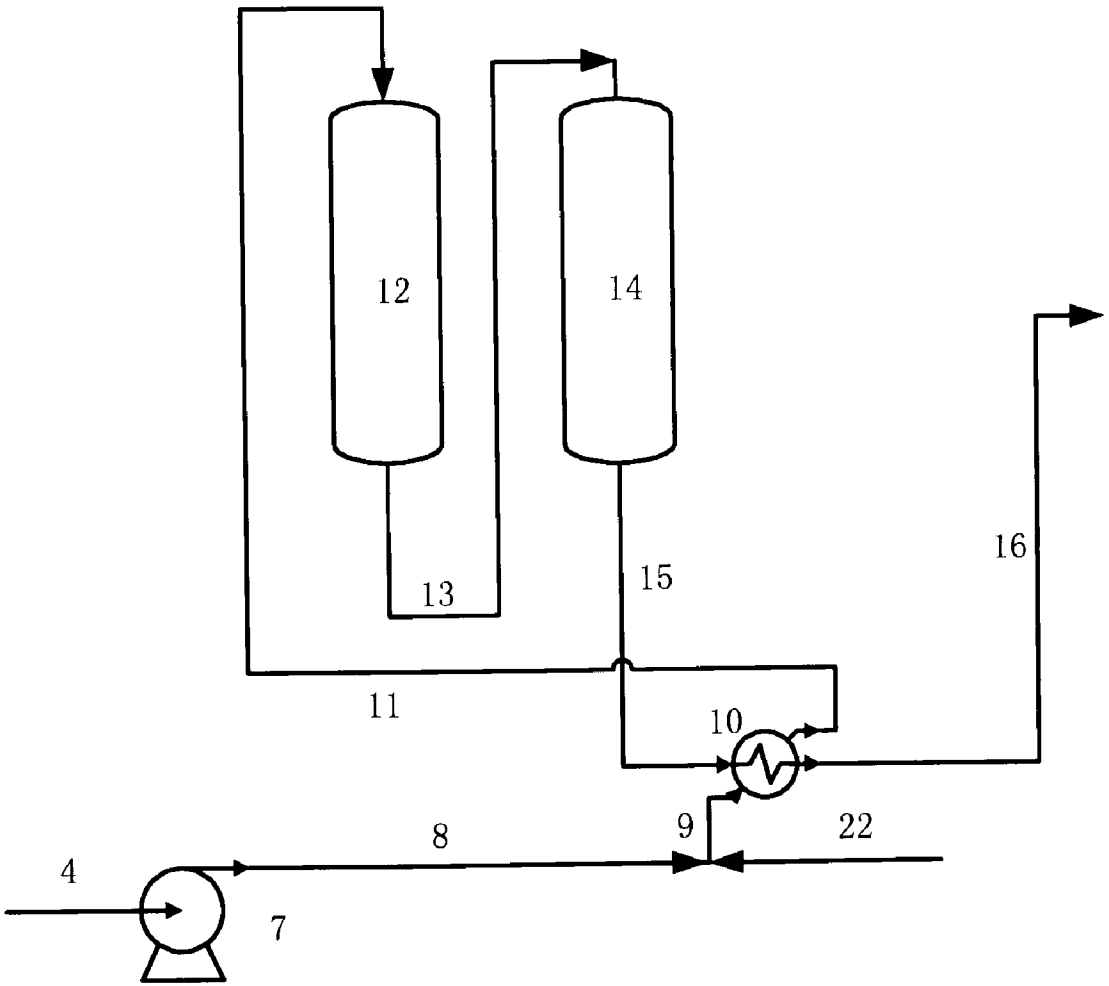
FIG. 2 is a flow chart that schematically depicts the process of the invention.

Now referring to FIG. 2, the gasoline feedstock enters pump 7 via line 4, and being pressurized, via line 8, mixed with hydrogen-rich gas from line 22, then the gasoline feedstock enters heat exchanger 10 via line 9, and then enters hydrorefining reactor 12, which is usually a fixed bed reactor, via line 11. In reactor 12, the gasoline feedstock and hydrogen are contacted with the hydrorefining catalyst contained therein. The effluent from reactor 12 enters paraffin-modification reactor 14 via line 13. In reactor 14, the hydrorefined gasoline feedstock and hydrogen are contacted with the paraffin-modification catalyst contained therein. The effluent from reactor 14 proceeds, via line 15, to heat exchanger 10 and line 16, to downstream unit (not shown) where it is separated to produce the hydrotreated gasoline fraction.

Figure 3:
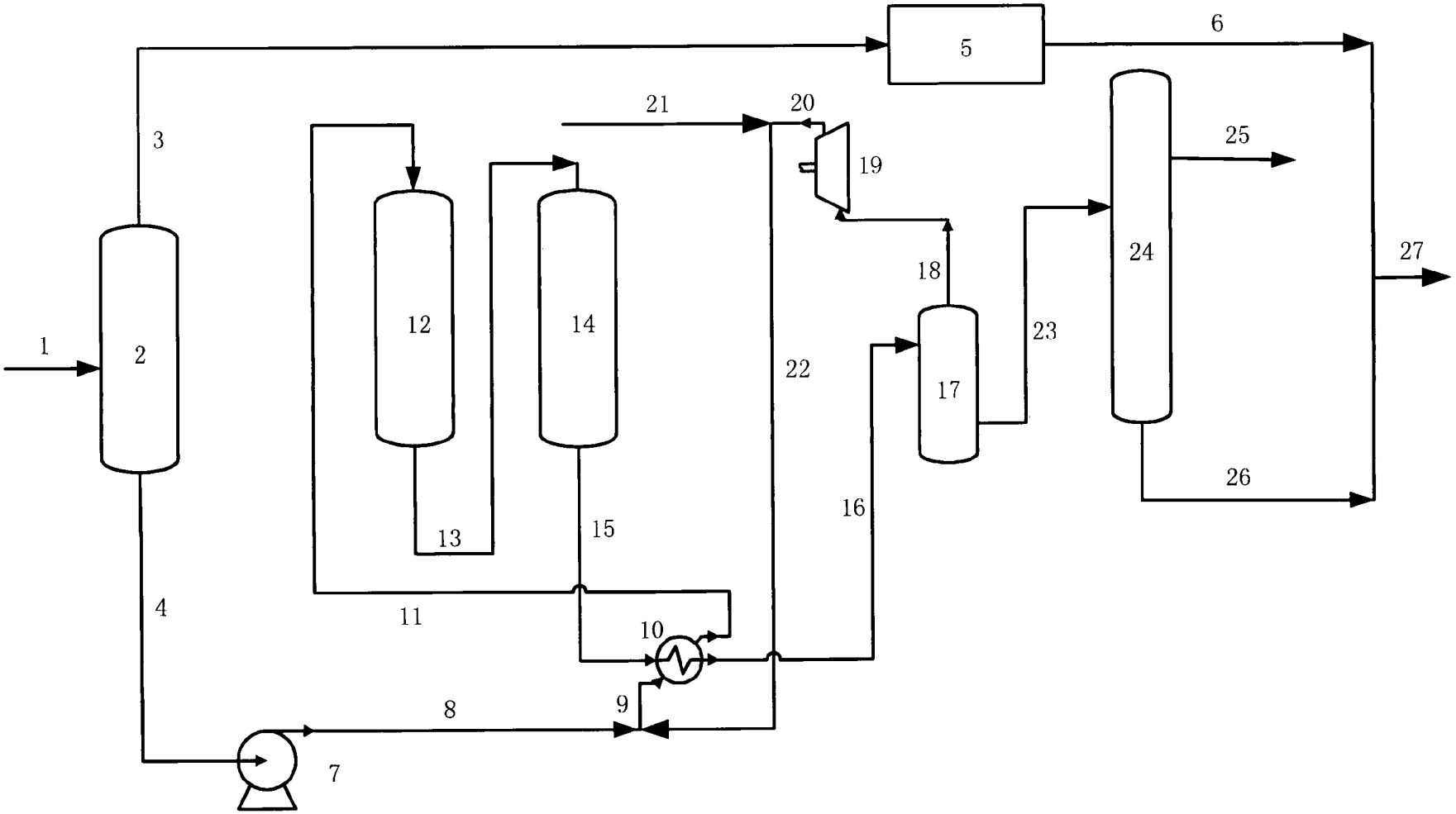
FIG. 3 is a flow chart that schematically depicts a preferred embodiment of the process of the invention.

FIG. 3 is a schematic diagram of the flow sheet of a preferred embodiment of the invention. As shown in FIG. 3, the gasoline feed, via line 1, enters fractionator 2 where it is cut into a light fraction and a heavy fraction. The light fraction enters alkali scrubbing unit 5 via line 3 and, after alkali scrubbing, it exits from unit 5 as sweetened light fraction and flows forward via line 6. On the other hand, the heavy fraction enters pump 7 via line 4, and being pressurized, via line 8, mixed with hydrogen-rich gas from line 22. The mixture, via line 9, enters heat exchanger 10, via line 11, enters the fixed-bed hydrorefining reactor 12 where it is contacted with a hydrorefining catalyst. The effluent from reactor 12, via line 13, enters the paraffin-modification reactor 14 where it is contacted with an paraffin-modification catalyst. The effluent from reactor 14, via line 15, heat exchanger 10 and line 16, enters high-pressure separator 17 where it is separated into hydrogen-rich gas and a liquid product. The hydrogen-rich gas from the top of separator 17 enters gas compressor 19 via line 18. The pressurized hydrogen-rich gas from line 20, optionally admixed with the fresh hydrogen from line 21, via line 22, is admixed with the heavy fraction from line 8. Meanwhile, the liquid product from the bottom of separator 17, via line 23, enters the stabilizer 24 where it is separated into light hydrocarbons and the hydrotreated gasoline fraction, exiting from stabilizer 24 via lines 25 and 26 respectively. Finally, the sweetened light fraction from line 6 and the hydrotreated gasoline fraction from line 26 are blended and withdrawn from line 27 as a final gasoline product.

Applying the present invention to process Chinese FCC gasolines with a high level of olefins (more than 50% by volume), a low level of aromatics (less than 20% by volume) and low final boiling point, the gasoline feed first is cut into light fraction and heavy fraction; and then sweentening the light fraction, and subjecting the heavy fraction to deep hydrodesulfurization, hydrodenitrogenation and olefin saturation reactions, and further subjecting it to paraffin-modification reactions to increase the ratio of i-paraffin to n-paraffin, e.g. by about 3 units, to produce a hydrotreated heavy fraction; and finally blending the sweentened light fraction and the hydrotreated heavy fraction to obtain a final gasoline product. The final product meets Tier II quality standard of <<World-wide Fuel Charter>>, i.e. a sulfur level less than 200 ppm and an olefin level less than 20% by volume with little loss, or even slight increase in the antiknock index, (RON+MON)/2, compared to feed. If the gasoline feedstock is contacted with a hydro-protecting catalyst before the feed is contacted with the hydrorefining catalyst, it can reduce the diene content to less than 0.2 gI/100 g, and therefore inhibit coking over the hydrorefining catalyst. Thus, the hydrorefining catalyst can be maintained at a high activity level over an extended period of time.

The following non-limiting examples are intended to illustrate the invention. In the examples, the employed hydrorefining catalyst and the paraffin-modification catalyst available from the Catalyst Plant of Changling Refinery, China Petroleum & Chemical Corporation (Yueyang City, Hunan Province, PRC) are CH-18 and RIDOS-1 respectively. The properties of the catalysts are summarized in table 1.

Catalyst RIDOS-1 comprises 1.3% by weight of NiO and 56.0% by weight of ZSM-5 zeolite, the balance being alumina.

The hydro-protecting catalyst used in the following examples are prepared as follows 341 g dry aluminum hydroxide powder is mixed with 393 g aluminum hydroxide powder with an alumina content of 70% prepared from aluminum sulfate by the Catalyst Plant of Changling Refinery. To the mixture, adding 47 g high abrasion-resistant carbon black powder, 35 g surf actant SA-20 (available from Tianjin Surfactant Plant, Tianjin City, PRC), 21 g aluminum nitrate, and 600 g water. The whole mixture is thoroughly ground and extruded to form 1.8 mm diameter trefoils. The trefoils are dried at 120° C. for 8 hours, and calcined in tube furnace at 600° C., with air flowing for 4 hours to give a supporter. 100 g of the prepared supporter is impregnated for 4 hours with 90 ml of an impregnating solution: 4 g nickel nitrate, 8 g ammonium molybdate, and 3 g potassium hydroxide in a 16% by weight strength ammonia solution. The impregnated supporter is dried at 120° C. for 4 hours and calcined at 420° C. for 4 hours, and once cooled, is further impregnated with 80 ml solution of 4 g nickel nitrate in water, dried at 120° C. for 4 hours and calcined at 420° C. for 4 hours to give a hydro-protecting catalyst, comprising 1.8% by weight of nickel oxide, 5.9% by weight of molybdenum oxide, and 1.9% by wieght of potassium oxide, the balance being alumina.

TABLE 1

Properties of the Catalysts

| Catalysts | CH-18 | RIDOS-1 |
|---|---|---|
| Composition, wt % | | |
| $WO_3$ | ≧19.0 | — |
| NiO | ≧2.0 | 1.3 |
| CoO | ≧0.04 | — |
| $SiO_2$ | — | 61 ± 4 |
| $Na_2O$ | — | ≦0.3 |
| $Fe_2O_3$ | — | ≦0.3 |
| Physical Properties | | |
| Surface Area, $m^2/g$ | ≧130 | <280 |
| Pore Volume, ml/g | ≧0.27 | ≧0.25 |
| Strength, N/mm | ≧16 | ≧12 |

COMPARATIVE EXAMPLE

The feed, FCC gasoline A, was cut at 80° C. to give 67.5% by weight of a heavy fraction (the remaining was the light fraction). The properties of the whole fractions and the heavy fraction of the feed were summarized in tables 2-3. The heavy fraction and hydrogen were contacted with the hydrorefining catalyst CH-18, but were not subjected to paraffin-modification. The hydrorefined heavy fraction obtained during the start operation of the process was blended with the light fraction, which has been subjected to sweetening, to give a final gasoline product. The properties of the hydrorefined heavy fraction obtained during the start operation of the process and the final gasoline product were summarized in table 4. Table 4 shows that the final gasoline product had a sulfur level of 8 ppm. However, the product had a loss of 9.9 units in antiknock index, (RON+MON)/2. At 800 hours from the start operation of the process, it was found that, if the impurity content in the hydrorefined heavy fraction was to be maintained at a level similar to that at the start operation of the process, the hydrorefining temperature for the CH-18 catalyst had to be increased by 5° C., as indicated in table 4. This implied that the heavy fraction of gasoline A contacting the hydrorefining catalyst without contacting a hydro-protecting catalyst before the hydrorefining catalyst bed caused accelerated inactivation of the hydrorefining catalyst.

Example 1

The comparative example was repeated except that the heavy fraction of gasoline A and hydrogen were successively contacted with a hydroprotecting catalyst, catalyst CH-18, and catalyst RIDOS-1, so as to deeply hydrodesulfurizing, hydrodenitrogenating, saturating olefins and increasing the ratio of i-paraffin to n-paraffin. The heavy fraction of gasoline A, after contacting the hydro-protecting catalyst, had a diene content of less than 0.2 gI/100 g; after contacting the hydrorefining catalyst, had a nitrogen content of less than 0.5 ppm and an olefin content of 0% by volume. The hydrotreated heavy fraction of gasoline A, obtained from hydro-protecting, hydrorefining and paraffin-modification reactions, was blended with the light fraction, which had been subjected to sweetening, to give a final gasoline product. The reaction conditions and the properties of the hydrotreated heavy fraction and the final gasoline product were summarized in table 4. Table 4 shows that the hydrotreated heavy fraction had an increase of 3.3 units in the ratio of i-paraffin to n-paraffin, and the final gasoline product had a sulfur level of 9 ppm, an olefin level of 18.2% by volume (lower by 31.1 percentage points than gasoline A) and an increase of 0.2 unit in antiknock index. At 800 hours from the start operation of the process, it was found that the impurity content in the hydrorefined heavy fraction was at a level similar to that at the start operation of the process, as indicated in table 4. This implied that the heavy fraction of gasoline A contacting a hydro-protecting catalyst before contacting the hydrorefining catalyst contributed to a stable operation of the process over an extended period of time.

Example 2

The feed, FCC gasoline B, was cut at 88° C. to give, based on the feed, 69.8% by weight of a heavy fraction (the remaining was the light fraction). The properties of the whole fractions and the heavy fraction of the feed were summarized in tables 2-3. The heavy fraction and hydrogen were successively contacted with a hydroprotecting catalyst, catalyst CH-18, and catalyst RIDOS-1, so as to effect deep hydrodesulfurization, hydrodenitrogenation, saturation of olefins and increase the ratio of i-paraffin to n-paraffin. The heavy fraction of gasoline B, after contacting the hydro-protecting catalyst, had a diene content of less than 0.2 gI/100 g; after contacting the hydrorefining catalyst, had a nitrogen content of 0.79 ppm and an olefin content of 0% by volume. The hydrotreated heavy fraction of gasoline B, obtained from hydro-protecting, hydrorefining and paraffin-modification reactions, was blended with the light fraction, which had been subjected to sweetening, to give a final gasoline product. The reaction conditions and the properties of the hydrotreated heavy fraction and the final gasoline product were summarized in table 5. Table 5 shows that the hydrotreated heavy fraction had an increase of 3.05 units in the ratio of i-paraffin to n-paraffin, and the final gasoline product had a sulfur level of 161 ppm, an olefin level of 16.9% by volume and an increase of 1.2 units in antiknock index.

Example 3

The feed, FCC gasoline C, was cut at 95° C. to give, based on the feed, 60.1% by weight of a heavy fraction (the remaining was the light fraction). The properties of the whole fractions and the heavy fraction of the feed were summarized in tables 2-3. The heavy fraction and hydrogen were successively contacted with a hydroprotecting catalyst, catalyst CH-18, and catalyst RIDOS-1, so as to effect deep hydrodesulfurization, hydrodenitrogenation, saturation of olefins and increase the ratio of i-paraffin to n-paraffin. The heavy fraction of gasoline C, after contacting the hydro-protecting catalyst, had a diene content of less than 0.2 gI/100 g; after contacting the hydrorefining catalyst, had a nitrogen content of 1.2 ppm and an olefin content of 0% by volume. The hydrotreated heavy fraction of gasoline C, obtained from hydro-protecting, hydrorefining and paraffin-modification reactions, was blended with the light fraction, which had been subjected to sweetening, to give a final gasoline product. The reaction conditions and the properties of the hydrotreated heavy fraction and the final gasoline product were summarized in table 5.

Table 5 shows that the hydrotreated heavy fraction had an increase of 2.6 units in the ratio of i-paraffin to n-paraffin, and the final gasoline product had a sulfur level of 100 ppm, an olefin level of 19.8% by volume and a loss of merely 0.6 unit in antiknock index.

It is understood that the foregoing detailed description and accompanying examples are merely illustrative and are not to be taken as limitations upon the scope of the invention, which is defined solely by the appended claims and their equivalents.

TABLE 2

Properties of the Feeds

| | Feed A | Feed B | Feed C |
|---|---|---|---|
| Density (20° C.), g/cm$^3$ | 0.7112 | 0.7083 | 0.7382 |
| Sulfur content, ppm | 85 | 1400 | 1300 |
| Olefin content, v % | 49.3 | 38.6 | 54.3 |
| Boiling range, ° C. | | | |
| Initial boiling point | 30 | 34 | 45 |
| 10% | 48 | 44 | 50 |
| 50% | 87 | 84 | 100 |
| Final boiling point | 181 | 196 | 211 |
| Antiknock index | 85.2 | 86.6 | 87.3 |

TABLE 3

Properties of the Heavy Fractions

| | HCN* of Gasoline A | HCN* of Gasoline B | HCN* of Gasoline C |
|---|---|---|---|
| Density (20° C.), g/cm$^3$ | 0.7432 | 0.7605 | 0.7836 |
| sulfur, ppm | 106 | 2100 | 1502 |
| nitrogen, ppm | 53 | 46 | 144 |
| Olefins, v % | 47.2 | 34.8 | 46.9 |
| Dienes, gI/100 g | 1.5 | 1.3 | 1.7 |
| Boiling range, ° C. | | | |
| Initial boiling point | 62 | 68 | 71 |
| 10% | 82 | 91 | 94 |
| 50% | 115 | 125 | 137 |
| Final boiling point | 186 | 189 | 220 |
| Anti-knock index | 83.0 | 82.6 | 85.4 |

*HCN: heavy fraction

TABLE 4

Reaction Conditions and the Properties of the Hydrotreated Heavy Fractions and the Final Gasoline Product

| Examples | Comp. example | | Example 1 | |
|---|---|---|---|---|
| Operating time, h | SOR* | 800 | SOR* | 800 |
| Hydrogen partial pressure, MPa | 3.2 | 3.2 | 3.2 | 3.2 |
| T, ° C., First reactor | 280 | 285 | 280 | 280 |
| Second reactor | — | — | 370 | 370 |
| Liquid hourly space velocity, h$^{-1}$ | | | | |
| First reactor | 4.0 | 4.0 | 4.0 | 4.0 |
| Second reactor | — | — | 0.8 | 0.8 |
| $H_2$/oil, Nm$^3$/m$^3$ | 500 | 500 | 500 | 500 |
| Effluent from the hydrorefining | | | | |
| sulfur, ppm | 5 | 5 | 5 | 6 |
| nitrogen, ppm | <0.5 | <0.5 | <0.5 | <0.5 |
| olefins, v % | 0 | 0 | 0 | 0 |
| Ratio of i-paraffin to n-paraffin | 3.3 | 3.3 | 3.3 | 3.3 |
| Properties of the hydrotreated heavy fractions | Without paraffin - modification | | | |
| Density (20° C.), g/cm$^3$ | 0.7400 | 0.7403 | 0.7237 | 0.7238 |
| sulfur, ppm | 5 | 4 | 3 | 3 |
| Mercaptan, ppm | <3 | <3 | <3 | <3 |

TABLE 4-continued

| Reaction Conditions and the Properties of the Hydrotreated Heavy Fractions and the Final Gasoline Product | | | | |
|---|---|---|---|---|
| Examples | Comp. example | | Example 1 | |
| nitrogen, ppm | <0.5 | <0.5 | <0.5 | <0.5 |
| Olefins, v % | 0 | 0 | 0 | 0 |
| Antiknock index | 59.4 | 59.6 | 75.9 | 76.0 |
| Ratio of i-paraffin to n-paraffin | 3.3 | 3.3 | 6.6 | 6.6 |
| Properties of final gasoline product | | | | |
| Density (20° C.), g/cm$^3$ | 0.7077 | | 0.6997 | |
| sulfur, ppm | 8 | | 9 | |
| olefins, v % | 19.3 | | 18.2 | |
| Antiknock index | 75.3 | | 85.4 | |

*SOR: start of running

TABLE 5

| Reaction Conditions and the Properties of the Hydrotreated Heavy Fractions and the Final Gasoline Product | | |
|---|---|---|
| Examples | Example 2 | Example 3 |
| Hydrogen partial pressure, MPa | 3.2 | 3.2 |
| T, ° C. | | |
| First reactor | 280 | 290 |
| Second reactor | 370 | 380 |
| Liquid hourly space velocity, h$^{-1}$ | | |
| First reactor | 4.0 | 4.0 |
| Second reacotr | 0.8 | 0.8 |
| $H_2$/oil, Nm$^3$/m$^3$ | 500 | 500 |
| Effluent from the hydrorefining | | |
| nitrogen, ppm | 0.79 | 1.2 |
| olefins, v % | 0 | 0 |
| Ratio of i-paraffin to n-paraffin | 3.95 | 3.1 |
| Properties of hydrotreated heavy fractions | | |
| Density (20° C.), g/cm$^3$ | 0.7421 | 0.7600 |
| sulfur, ppm | 28 | 36 |
| mercaptan, ppm | <3 | <3 |
| nitrogen, ppm | <0.5 | <0.5 |
| olefins, v % | 0 | 0 |
| Antiknock index | 82.6 | 81.2 |
| Ratio of i-paraffin to n-paraffin | 7.0 | 5.7 |
| Properties of final gasoline products | | |
| Density (20° C.), g/cm$^3$ | 0.7077 | 0.7300 |
| sulfur, ppm | 161 | 100 |
| olefins, v % | 16.9 | 19.8 |
| Antiknock | 87.8 | 86.7 |

The invention claimed is:

1. A process for reducing sulfur and olefin contents in gasoline, comprising:

a) contacting gasoline feedstock containing 35-70% by volume of olefins and hydrogen with a hydrorefining catalyst under reaction conditions including a hydrogen/gasoline ratio of 200-600 Nm$^3$/m$^3$, a hydrogen partial pressure of 1.0 to 4.0 MPa, a temperature of 200-380° C. and a liquid hourly space velocity of 3.0-5.0 h$^{-1}$;

b) contacting the hydrorefined gasoline and hydrogen with a paraffin-modification catalyst under reaction conditions including a hydrogen/gasoline ratio of 200-1000 Nm$^3$/m$^3$, a hydrogen partial pressure of 1.0-4.0 MPa, a temperature of 300-460° C. and a liquid hourly space velocity of 0.5-4.0 h$^{-1}$ to provide an effluent, which is separated to obtain the hydrotreated gasoline fraction, wherein the paraffin-modification catalyst comprises one or more noble or non-noble metals from Group VIII and/or Group VIB, supported over a supporter containing at least a ZSM-5 zeolite; and wherein the effluent from the hydrorefining reaction has a nitrogen content of less than 2 ppm and an olefin content of less than 5% by volume.

2. The process of claim 1, wherein said gasoline feedstock is FCC gasoline, DCC gasoline, straight-run gasoline, coker gasoline, pyrolysis gasoline, thermal cracking gasoline and a mixture thereof.

3. The process of claim 2, wherein said gasoline feedstock is the whole fractions, or a part of the whole fractions of FCC gasoline, DCC gasoline, straight-run gasoline, coker gasoline, pyrolysis gasoline, thermal cracking gasoline and a mixture thereof.

4. The process of claim 3, wherein said gasoline feedstock is a heavy fraction of FCC gasoline, deep catalytic cracking gasoline, straight-run gasoline, coker gasoline, pyrolysis gasoline, thermal cracking gasoline and a mixture thereof cut at a temperature of 70-100° C.

5. The process of claim 1, wherein the gasoline feedstock contains 35-60% by volume of olefins.

6. The process of claim 1, wherein the hydrorefining catalyst comprises one or more non-noble metals from Group VIB and Group VIII supported over an alumina or amorphous aluminum silicate.

7. The process of claim 1 or 6, further comprising contacting the gasoline feedstock with a hydro-protecting catalyst before the hydrorefining catalyst bed.

8. The process of claim 7, wherein said hydro-protecting catalyst comprises one or more metals from Group VIII, one or more metals from Group VIB, and one or more alkali metals, supported over an alumina supporter.

9. The process of claim 8, wherein said hydro-protecting catalyst comprises an alumina supporter and, Co and/or Ni, Mo and/or W and an alkali metal, supported over the alumina supporter, all calculated as oxides and based on the total amount of the catalyst, wherein the catalyst comprises 0.5-8% by weight of Co and/or Ni, 2-25% by weight of Mo and/or W and 0.5-8% by weight of the alkali metal, the balance being the alumina supporter.

10. The process of claim 9, wherein said hydro-protecting catalyst comprises Co and/or Ni in an amount of 1-6% by weight, Mo and/or W in an amount of 4-12% by weight and the alkali metal in an amount of 2.5-6% by weight, all calculated as oxides and based on the total amount of the catalyst, the balance being the alumina supporter.

11. The process of claim 1, wherein the paraffin-modification catalyst comprises 0.5-10% by weight of one or more metals from Group VIII, and 10-75% by weight of the ZSM-5 zeolite, the balance being alumina.

12. The process of claim 11, wherein the paraffin-modification catalyst comprises 1-5% by weight of Ni and/or Co, 5-30% by weight of W or Mo and 30-40% by weight of ZSM-5 zeolite, the balance being alumina.

* * * * *